United States Patent [19]

Helm

[11] 4,066,021

[45] Jan. 3, 1978

[54] HIGH SPEED TRANSPORTATION SYSTEM

[76] Inventor: Axel-Günther Helm, Heubergstrasse 3, D-8201 Neubeuern, Germany

[21] Appl. No.: 707,007

[22] Filed: July 20, 1976

Related U.S. Application Data

[63] Continuation-in-part of Ser. No. 326,407, Aug. 20, 1973, abandoned.

[51] Int. Cl.[2] ..... B61B 13/10

[52] U.S. Cl. ..... 104/138 R; 104/167; 105/365

[58] Field of Search ..... 104/138 R, 138 G, 147 R, 104/154, 155, 156, 157, 158, 159, 166, 167; 105/365; 244/102 R, 103 R, 103 S; 295/1; 305/1, 2, 8

[56] References Cited

U.S. PATENT DOCUMENTS

| | | | |
|---|---|---|---|
| 3,006,288 | 10/1961 | Brown | 104/138 R |
| 3,364,874 | 1/1968 | Toennesen | 104/166 |
| 3,508,497 | 4/1970 | Matsukata | 104/138 R |
| 3,591,241 | 7/1971 | Allen | 104/147 R X |
| 3,656,436 | 4/1972 | Edwards | 104/138 R |

*Primary Examiner*—Albert J. Makay
*Assistant Examiner*—Randolph A. Reese
*Attorney, Agent, or Firm*—Lowe, King, Price & Markva

[57] ABSTRACT

A high speed transportation system designed to reduce frictional heat generated between the wheels and the track upon which the wheels are rotating in which a plurality of wheels are successively placed in contact with a track having a concave surface and removed therefrom so as to provide an "out of contact" period for cooling of the wheels. The concave surface of the track is provided with helically curved ribs which effect rotation of the carriage carrying the wheels thereby bringing the wheels successively into and out of contact with the rail.

7 Claims, 5 Drawing Figures

HIGH SPEED TRANSPORTATION SYSTEM

This is a continuation-in-part of U.S. application Ser. No. 326,407 filed Aug. 20, 1973 and now abandoned.

This invention relates to an alternating wheel contact system particularly for use in high speed transportation systems and, more particularly, in high speed vacuum railway systems.

The state of the art in railway transportation is determined by requirements of safety, rationalization and time saving, mass demands and comfort. As a continental transportation system, railways have grown over the course of 150 years to their present complexity, serving and connecting densely populated areas. Increases in tractive power, fine adjustments and levelling of track facilities, curve stabilizing devices, improvements to the chassis and aerodynamic configurations have led to a level of performance so that today speeds of up to 400 km/h are possible under certain optimum conditions and have in fact been achieved in such countries as France and Japan.

Monorails (up to 120 km/h), air cushion railways (up to 400 km/h) and magnetic suspension techniques are among the directions of development taken in railway transportation, but there is presently no indication that these will achieve continental significance.

Aerodynamic resistance, including the influence of the wind, is a factor which tends to limit the possible maximum speeds of conventional systems to about 400 km/h. In order to effect any major improvement in rail transportation, it is obvious that aerodynamic resistance must be overcome. Japanese scientists have recently achieved speeds up to about 2300 km/h with model systems and such speeds are no longer unusual in aeronautics and in the vacuum of nuclear accelerator plants. The present, largely theoretical, maximum speed of 2300 km/h achieved in model experiments makes the technical possibilities of earth bound vacuum railways apparent.

Human acceleration tolerances and the doubts of human medicine can, on high performance railways, be controlled by acceleration and braking force limitation systems using presently available technical means without regard to achievable speeds.

High vacuum engineering already has many applications and, indeed, large areas of land are presently being drained by closed high-capacity pump systems, so that it is believed entirely feasible to provide large scale vacuum tunnels using specific vacuum pumps. The reduction of aerodynamic resistance with the aid of 100–600 torr would alone represent such a great advance in increasing acceleration that this would, in technically mature systems, only indicate the direction of development which, in railway transportation, began with minimum speeds of about 20 km/h. The advantages offered by high performance railways and the later perfect vacuum railways as compared with the present state of the art are apparent.

Apart from safety considerations, the primary obstacles opposing technically optimum performances are the heat of friction and direct material wear at ultra-high speeds. My invention of an alternating wheel contact system for high performance railways has as its main objective the reduction of the frictional heat generated at gliding zones at high speeds. As used herein, the term "gliding zones" is intended to mean that period or distance of contact between a wheel and a track.

Although the conventional wheel would, from the point of view of cooling, be a favorable solution, it would need to be of such size for use in a high performance railway that it would cause unjustifiably high costs in the tunnel systems of perfect vacuum railways.

Thus, by one aspect of the present invention, there is provided a transport system comprising: a vehicle body; a plurality of shafts disposed around said vehicle body and supported thereby axially parallel to the direction of travel of the vehicle body; a plurality of tracks disposed around said vehicle body, a concave surface of each track being coaxial with an adjacent said shaft; carriage means axially mounted on each of said shafts for rotation thereon; and a plurality of wheels rotatably mounted on each said carriage means having their axes of rotation in a single plane perpendicular to the axes of said shafts for successive engagement with and disengagement from a running surface of an adjacent said track.

Hereinafter the invention will be described in more detail by way of example with reference to the accompanying drawings, in which.

The embodiment illustrated by way of example comprises a streamlined front vehicle 1 and a rear vehicle 1' articulated thereto and driven by a rocket motor 10, arranged in a tunnel or vacuum tube 2 having three concave rails 3, one on top on the longitudinal center plane, and two on the bottom symmetrically on both sides of said plane.

Figure 3:
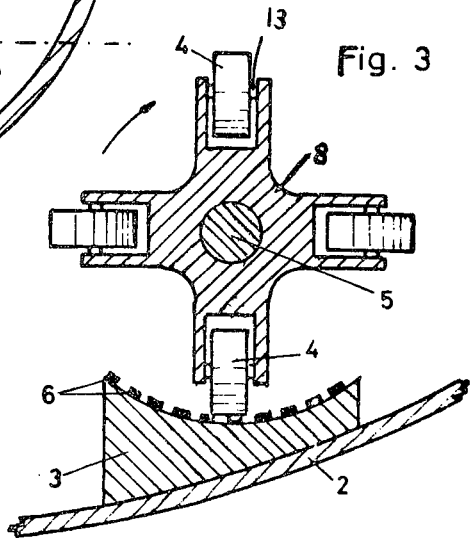
FIG. 3 shows a detail of FIG. 2 on yet a larger scale.

Coaxially to the concave curvature of the profile of each rail 3 there is journalled on each vehicle 1 and 1' a longitudinal shaft 5 on which there is mounted a carriage 8, which preferably consists of four radially extending arms perpendicular to each other at the end of which a wheel 4 is journalled by means of an axle 13, which is in a plane perpendicular to the longitudinal shaft 5. As best shown in FIG. 3, wheels 4 are arranged for successive running on rail 3. As indicated by the curved arrow, by turning the carriage 8 about the axis of the shaft 5, the wheels 4 are successively being placed on rail 3 and lifted off the same.

Figure 1:
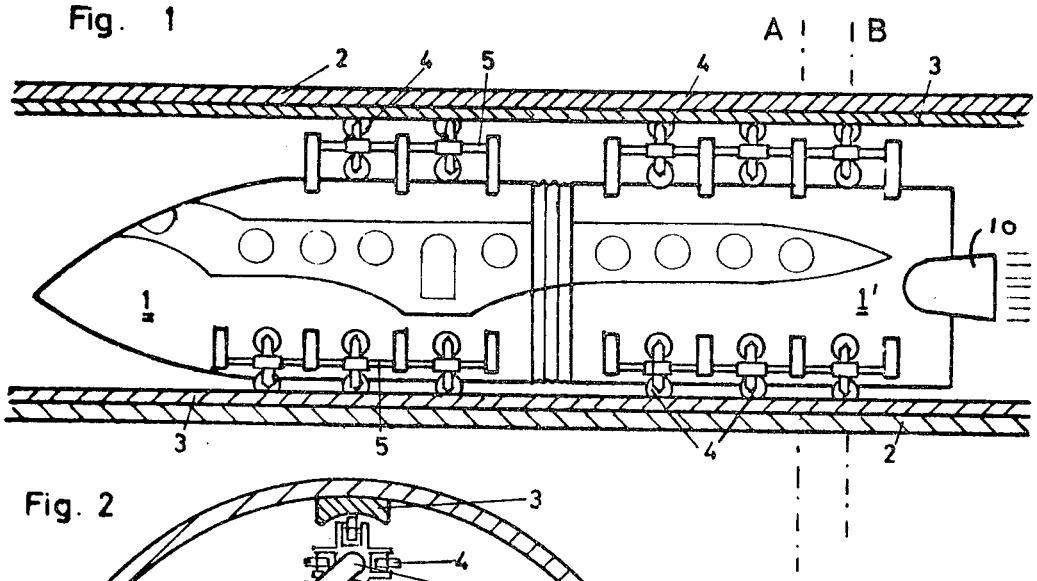
FIG. 1 shows in sectional elevation part of a tunnel with a streamlined two-coach train therein, driven by a rocket motor.
Figure 2:
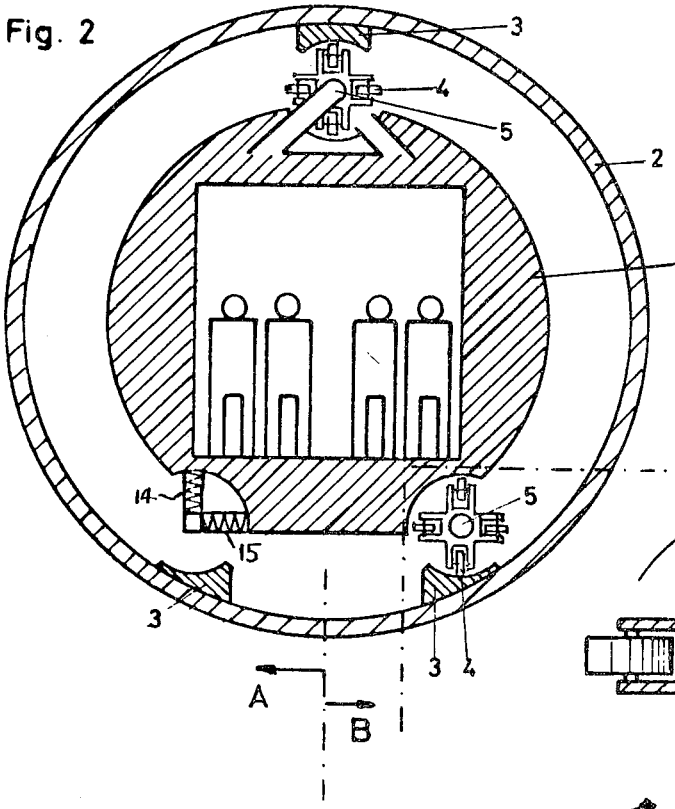
FIG. 2 is a cross-section on a larger scale, the left half on the line "A" and the right half on the line "B" of FIG. 1.

As shown on the left hand lower corner of FIG. 2, the shaft 5 is supported against the vehicle body 1 by helical compression springs 14 and 15 positioned vertically and horizontally, respectively.

As best seen in FIG. 3, the concave surface of the rail 3 is covered by discrete longitudinal strips 6 allowing better guidance of the wheels 4 in contact with them. Moreover, not only are the wheels 4, when out of contact with the rail 3, but also the active surface of the rail itself, efficiently cooled. In a preferred embodiment of the present invention, the ribs 6 are helically curved, like the rifling of a ballistic gun barrel, so that a lateral force is applied to the wheels actually in contact with the ribs 6 of the rail 3 causing rotation of the carriage 8 without the necessity of an externally powered means to rotate the carriage 8. However, means (not shown) may be provided for turning carriages 8 about the axis of shaft 5. Obviously, not all of the carriages are moved simultaneously so as to ensure that the vehicle body 1 is always sustained by some of the wheels 4.

My principle of reducing frictional heat is an "alternating wheel" system in which the wheels 4 have alternate employment or heating phases and rest or cooling phases. Heat exchange between the regenerators is by conduction, supplemented by radiation. Separate or alternative cooling systems are also possible. In the specimen design shown in the drawings, an employment phase with rail 3 contact of approximately 25% alternates with a cooling phase of approximately 75%. The phase sequence is regulatable and adaptable both in time and space. Although the slowing down of the wheels 4 during free running in the cooling phase will reduce the success of cooling, it is considered that the mathematically simplest design applying this principle will be at least 50% more efficient than permanent wheel contact; the loss of peripheral speed can be kept relatively low by suitable ball bearings and material quality.

The specimen design shown in the drawings contains a further improvement on the described technical solution in that the concave surface of rail 3, employed as a path of travel for the gliding wheels 4, is provided with intermittent rifled sections 6, such as known in ballistics for barrels or in gearing for screw drives. The remaining fields in the surface of the rail 3 which alternate with the lower, slightly spiral sections and the interruptions of the fields fulfill three tasks. Firstly, precise, temporary suspended gliding of each individual wheel as it passes over the break in rifling is achieved so that momentarily there is no frictional contact between the rail 3 and an individual gliding wheel 4. It will be appreciated that sufficient carriages 8 are provided so that, at any instant of time, sufficient wheels 3 are in frictional contact with track 4 to prevent collapse of the vehicle body 1 onto the track. Secondly, directional stability is increased, and thirdly, the carriage 8 receives a free-running self-drive from the given angular momentum. The self-drive aspect of this invention, provided by the rifling effect, is mathematically limited and it may prove necessary to supplement the rotational effect by means of a mechanical drive such as an electrical motor, particularly in the lower speed ranges.

The use of three concave rails 3 — left, right and top — in a triangular arrangement is believed to be the technically most reliable solution. Theoretically, the present state of the art in respect of stabilization rockets would make monorail systems or even suspended systems possible. However, both of these solutions are believed unacceptable for safety reasons. Twinrail guiding with conventionally profiled rails also appears impractical because of the excessive frictional heat generated.

A further possibility in respect of the present invention resides in lifting wheels 4 in a phase sequence which is controlled by regulating elements with suitable eccentric discs or cams, so that exact rest periods could be achieved. This is a task for gear engineering to design suitable cam drives and requires no further inventive efforts but only routine design work.

It is also assumed to be a known fact that straight-thrust cranks, for example, offer possibilities of reducing the disadvantages of cam gears (wear, sealing faults) with which the alternating principle can be applied in a refined and more complicated manner.

Although the present invention has been illustrated by reference to a carriage having four radial arms perpendicular to each other, the invention is also applicable to other angular positions and numbers of arms. For example, four gliding wheels 4 at one take-off point of the axle 5 could be replaced by eight or only two wheels. The nub of the present invention resides not in the number of wheels but in the continuous placing and removal of the gliding wheels from the rail with a relatively longer rest phase as compared to the employment phase.

Other alternatives will readily suggest themselves to those skilled in the art without departing from the spirit and scope of the present invention which is to be construed only in relation with the appended claims.

I claim:

1. A transportation system comprising:

a vehicle body;

a plurality of shafts disposed around said vehicle body and supported thereby axially parallel to the direction of travel of said vehicle body;

a plurality of tracks disposed around said vehicle body, a concave surface of each track being coaxial with an adjacent said shaft and including a plurality of helically curved ribs forming the running surface thereof;

carriage means axially mounted on each of said shafts for rotation thereon; and a plurality of wheels rotatably mounted on each said carriage means having their axes of rotation in a single plane perpendicular to the axes of said shafts for successive engagement with and disengagement from said running surface of an adjacent said track.

2. A transportation system as claimed in claim 1 wherein each said carriage means comprises four radial arms perpendicular to each other and a said wheel is rotatably mounted on each said arm.

3. A transportation system as claimed in claim 1 including power means to rotate each said carriage means.

4. A transportation system as claimed in claim 1 wherein a first shaft is disposed at the top of said vehicle on the longitudinal center plane and second and third shafts are disposed on the bottom of said vehicle symmetrically on both sides of said plane.

5. A transportation system as claimed in claim 4 wherein three said tracks are mounted in a tunnel, each in coaxial relation to an adjacent said shaft.

6. A transportation system as claimed in claim 5 wherein said tunnel is a vacuum tube.

7. A transportation system comprising:

a vehicle body;

at least one shaft disposed externally of said body and supported thereby axially parallel to the direction of travel of said body;

at least one track adjacent said body, each said track having a concave surface coaxial with an adjacent said shaft and including a plurality of helically curved ribs forming the running surface thereof;

carriage means axially mounted on each said shaft for rotation thereon; and a plurality of wheels rotatably mounted on each said carriage having their axes of rotation in a single plane perpendicular to the axes of said shafts for successive engagement with and disengagement from said running surface of an adjacent said track.

* * * * *